US009849360B2

(12) United States Patent
Carroll, Jr. et al.

(10) Patent No.: US 9,849,360 B2
(45) Date of Patent: Dec. 26, 2017

(54) GOLF TEE WITH BALL SUPPORT

(71) Applicant: Green Keepers, Inc., Philadelphia, PA (US)

(72) Inventors: James Carroll, Jr., Richboro, PA (US); Francis Carroll, Holland, PA (US)

(73) Assignee: Greenkeepers, Inc., Philadelphia, PA (US)

( * ) Notice: Subject to any disclaimer, the term of this patent is extended or adjusted under 35 U.S.C. 154(b) by 0 days.

(21) Appl. No.: 14/960,098

(22) Filed: Dec. 4, 2015

(65) Prior Publication Data

US 2017/0157477 A1 Jun. 8, 2017

(51) Int. Cl.
*A63B 57/00* (2015.01)
*A63B 57/10* (2015.01)

(52) U.S. Cl.
CPC ..... *A63B 57/10* (2015.10)

(58) Field of Classification Search
CPC ..... A63B 57/0018; A63B 57/0043; A63B 2209/00; A63B 57/10; A63B 57/16
USPC ..... 473/387–403, 417–420
See application file for complete search history.

(56) References Cited

U.S. PATENT DOCUMENTS

| | | | |
|---|---|---|---|
| 638,920 | A | 12/1899 | Grant |
| 1,551,207 | A | 8/1925 | Nial et al. |
| 1,554,321 | A | 9/1925 | Banigan |
| 1,573,911 | A | 2/1926 | Budrow |
| 1,588,038 | A | 6/1926 | Miller |
| 1,679,579 | A | 8/1928 | Lundy |
| D78,530 | S | 5/1929 | McLeod |
| 2,531,470 | A | 11/1950 | Richard |
| D200,543 | S | 3/1965 | Thornte |
| 3,414,268 | A | 12/1968 | Chase |
| 3,633,919 | A | 1/1972 | Liccardello |
| 3,645,537 | A | 2/1972 | Parenteau |
| 3,656,245 | A | 4/1972 | Wilson |
| 3,672,077 | A | 6/1972 | Coles |
| 3,816,617 | A | 6/1974 | Dassler et al. |
| 4,309,376 | A | 1/1982 | Ueno et al. |
| 4,327,503 | A | 5/1982 | Johnson |
| 4,330,950 | A | 5/1982 | Reddien |
| 4,366,632 | A | 1/1983 | Bente et al. |

(Continued)

FOREIGN PATENT DOCUMENTS

| | | |
|---|---|---|
| EP | 1072291 | 1/2001 |
| JP | 04189374 | 7/1992 |

(Continued)

OTHER PUBLICATIONS

Advertisement for "Zero Friction Golf Tee," retrieved from www.zerofrictiontees.com on Aug. 28, 2008.

(Continued)

*Primary Examiner* — Nini Legesse
(74) *Attorney, Agent, or Firm* — Blank Rome LLP; Michael C. Greenbaum; Tara L. Marcus

(57) ABSTRACT

A golf tee that includes a stake that has an insertion end and a crown for supporting a golf ball. The crown is supported by the stake opposite the insertion end. The crown has a plurality of external prongs, a cup portion defined between the plurality of external prongs, and at least one internal post that extends from a base of the cup portion. The internal post is disposed on the base of the cup portion between the plurality of external prongs.

22 Claims, 2 Drawing Sheets

(56) References Cited

U.S. PATENT DOCUMENTS

| | | | | |
|---|---|---|---|---|
| 4,375,728 | A | 3/1983 | Dassler et al. | |
| 4,392,312 | A | 7/1983 | Crowley et al. | |
| 4,527,345 | A | 7/1985 | Lopez Lopez et al. | |
| 4,837,949 | A | 6/1989 | Dufour et al. | |
| 4,885,851 | A | 12/1989 | Peterson | |
| 5,372,362 | A | 12/1994 | Barker | |
| 5,413,348 | A | 5/1995 | Basso | |
| D369,845 | S | 5/1996 | Knez | |
| 5,581,913 | A | 12/1996 | Kataoka et al. | |
| 5,759,118 | A | 6/1998 | Sroczynski | |
| D485,317 | S * | 1/2004 | Cardarelli | D21/718 |
| 6,849,008 | B1 | 2/2005 | Wang | |
| D516,146 | S | 2/2006 | Iacono et al. | |
| 7,011,586 | B2 | 3/2006 | Toyosawa et al. | |
| 7,090,594 | B2 | 8/2006 | Kawashima et al. | |
| 7,156,758 | B2 | 1/2007 | Lu | |
| D543,597 | S * | 5/2007 | Lee | D21/718 |
| 7,344,456 | B2 | 3/2008 | Hayton | |
| D566,802 | S | 4/2008 | Carroll et al. | |
| 7,704,166 | B2 | 4/2010 | Lim | |
| D629,474 | S * | 12/2010 | Keogh | D21/718 |
| D715,877 | S * | 10/2014 | Carroll | D21/718 |
| 2002/0198066 | A1 | 12/2002 | Salsman | |
| 2004/0166964 | A1* | 8/2004 | Toyosawa | A63B 57/16 473/387 |
| 2005/0003907 | A1* | 1/2005 | Ijiri | A63B 57/10 473/387 |
| 2005/0130769 | A1 | 6/2005 | Olsen | |
| 2005/0187041 | A1 | 8/2005 | Kawashima et al. | |
| 2006/0276269 | A1 | 12/2006 | Kihara | |
| 2007/0149324 | A1 | 6/2007 | Tsai | |
| 2007/0298910 | A1 | 12/2007 | Potempa et al. | |
| 2008/0070724 | A1 | 3/2008 | Elder | |
| 2008/0119305 | A1 | 5/2008 | Wong | |
| 2008/0182684 | A1* | 7/2008 | Carroll | A63B 57/10 473/398 |
| 2012/0028734 | A1 | 2/2012 | Mackeen | |
| 2013/0337944 | A1* | 12/2013 | Lee | A63B 57/00 473/396 |
| 2015/0290508 | A1* | 10/2015 | Dorsey | A63B 57/16 473/387 |

FOREIGN PATENT DOCUMENTS

| | | | |
|---|---|---|---|
| JP | 2005021611 | A | 1/2005 |
| JP | 2005296330 | | 10/2005 |
| JP | 2006341016 | A | 12/2006 |
| KR | 20010099365 | | 11/2001 |
| KR | 200339010 | | 1/2004 |
| WO | WO-2005003907 | A2 | 1/2005 |
| WO | WO-2005/032668 | | 4/2005 |

OTHER PUBLICATIONS

Microfilmed Text of Japanese Utility Model Application No. SHO 47-117361 (Japanese Utility Model Public Disclosure No. SHO 49-73560).

Microfilmed Text of Utility Model Application No. HEI 2-59955 (Japanese Utility Model Public Disclosure No. HEI 4-18553).

Japanese Patent Public Disclosure No. 2005-298330.

Microfilmed Text of Utility Model Application No. SHO 48-73686 (Japanese Utility Model Pbulic Disclosure No. SHO 50-20773).

* cited by examiner

GOLF TEE WITH BALL SUPPORT

RELATED APPLICATION

Ornamental aspects of the present invention are disclosed in commonly owned and concurrently filed U.S. design patent application Ser. No. 29/547,623, entitled Golf Tee, the subject matter of which is hereby incorporated by reference.

FIELD OF THE INVENTION

The present invention relates to a golf tee with a support for the golf ball. More specifically, the golf tee is designed to support a golf ball in such a manner that the ball's spin rate is reduced, the ball's distance is increased, and the ball's speed is maximized.

BACKGROUND OF THE INVENTION

Conventional golf tee designs fail to optimize the spin rate of the golf ball when struck, optimize the distance of the golf ball when struck, and maximize ball speed. Traditional golf tees are designed to hold a golf ball inside a cup or socket to stabilize the ball prior to the ball being struck. The design of these cups of conventional golf tees, however, causes excess backspin on the ball when struck. This is because when the ball is struck, there is resistance from the cup of the golf tee that causes the ball to spin at a more rapid pace and balloon, thereby decreasing the distance and speed of the ball.

Therefore, a need exists for a golf tee that creates less resistance and thus a low ball spin rate when the ball is struck, thereby increasing the overall distance of the ball and maximizing the speed of the ball.

SUMMARY OF THE INVENTION

Accordingly, the present invention provides a golf tee that includes a stake that has an insertion end and a crown for supporting a golf ball. The crown is supported by the stake opposite the stake's insertion end. The crown has a plurality of external prongs, a cup portion defined between the plurality of external prongs, and at least one internal post that extends from a base of the cup portion. The internal post is disposed on the base of the cup portion between the plurality of external prongs. In a preferred embodiment, there are three external prongs spaced equidistant from one another and the internal post is centrally disposed between the prongs.

The present invention may also provide a golf tee that includes a stake that has an insertion end and a crown for supporting a golf ball. The crown is supported by the stake opposite the stake's insertion end. The crown has a plurality of external prongs, a cup portion defined between the plurality of external prongs, and at least one internal post extending from a base of the cup portion. The internal post is disposed on the base of the cup portion between the plurality of external prongs. The internal post has a height measured from the base that is less than a height of each of the plurality of external prongs measured from the base, such that each of the plurality of external prongs defines a ball contact surface at an inner edge thereof, and the internal post defines a ball contact surface at an end face of a free end thereof. In a preferred embodiment, the ball contact surface of the internal post is configured to accept the majority of the weight of the golf ball.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE EXEMPLARY EMBODIMENT

Figure 1:
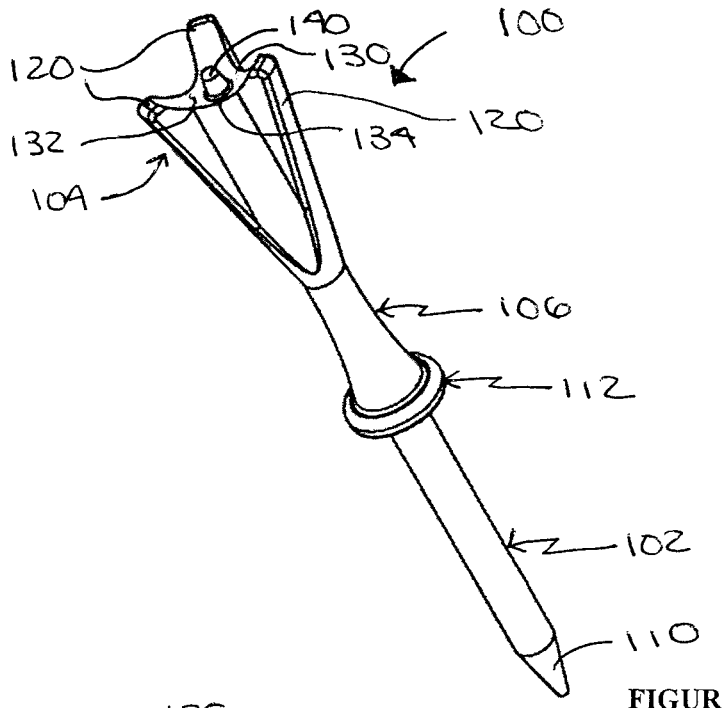
FIG. 1 is a perspective view of a golf tee according to an exemplary embodiment of the present invention.

Referring to FIGS. 1-6, the following is a detailed description of an exemplary embodiment of the present invention. In general, the present invention relates to a golf tee 100 designed to reduce resistance on the golf ball to produce the lowest spin rate of the golf ball when struck, in comparison to conventional golf tees. For example, the golf tee of the present invention produces a spin rate of the ball of 3395.1 rotations per minute compared to 3712 rotations per minute for a ball on a conventional golf tee, which is a 10% lower spin rate on the ball for the present invention. That lower spin rate on the ball results in a significant increase in the distance achieved by the ball and a signification increase in the speed of the ball. For example, a distance of 253.5 yards is achieved with the present invention versus only 250 yards for conventional golf tees, and a ball speed of 60.6 mph is achieved with the present invention as compared to 60.1 mph for a ball on a conventional golf tee. Thus the design of the golf tee of the present invention maximizes the distance and speed achieved by the golf ball. The golf tee 100 generally includes a stake 102 for inserting the golf tee 100 into the ground or other support, a crown 104 for supporting the golf ball, and a neck 106 between the stake 102 and the crown 104.

Figure 2:
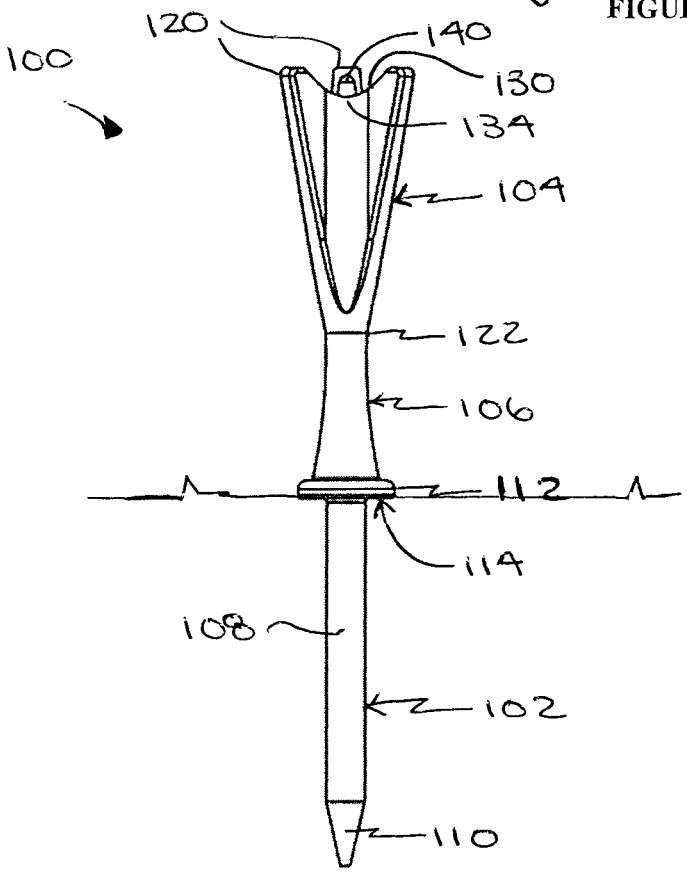
FIG. 2 is a side elevational view of the golf tee illustrated in FIG. 1.

The stake 102 of the golf tee 100 includes a narrow elongated body 108 shaped and sized for insertion into the ground or other support, as best seen in FIG. 2. A distal end of the stake 102 is the insertion end 110 of the stake 102. The insertion end 110 is preferably pointed to facilitate insertion into the ground or other support.

The golf tee 100 may optionally include a tee height indicator 112. In a preferred embodiment, the tee height indicator 112 is located adjacent the stake 102 opposite the stake's insertion end 110. The tee height indicator 112 includes a ground abutment surface 114 for stopping against the ground or other support when the golf tee 100 is inserted and ready to receive a golf ball, thereby indicating the optimal height of the golf tee 100. In a preferred embodiment, the tee height indicator 112 is an outwardly extending annular shoulder located between the neck 106 and the stake 102 where the ground abutment surface 114 faces the insertion end 110 of the stake 102, as seen in FIG. 2.

Figure 3:
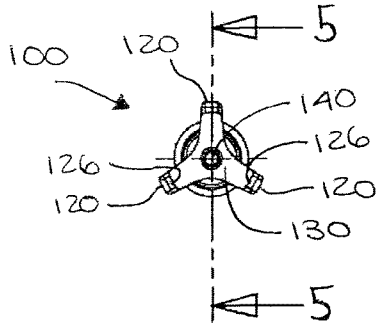
FIG. 3 is a top view of the golf tee illustrated in FIG. 1.
Figure 4:
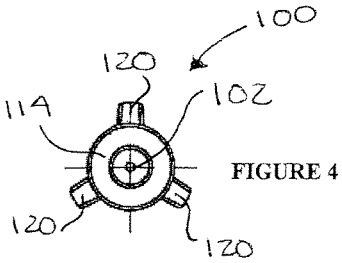
FIG. 4 is a bottom view of the golf tee illustrated in FIG. 1.
Figure 6:
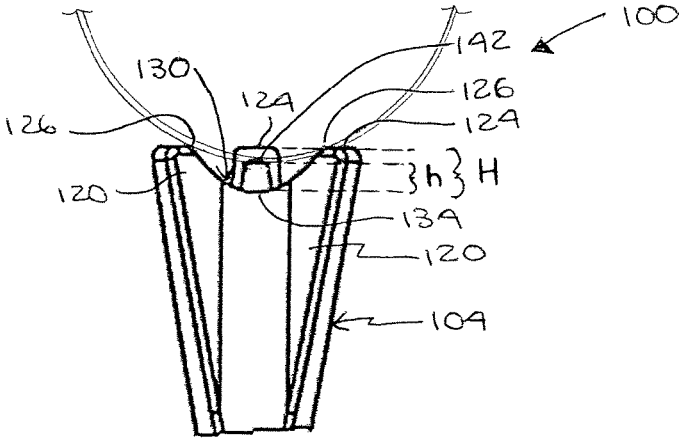
FIG. 6 is an enlarged partial side view of the golf tee illustrated in FIG. 1.

The crown 104 supports the golf ball and is configured to reduce resistance of the golf ball when struck. The crown 104 may include a plurality of external prongs 120. The external prongs 120 are joined at the bottom at an end 122 of the neck 106 remote from the stake 102. The external prongs 120 preferably taper outwardly from the bottom in a direction away from the neck 106. Each external prong 120 has an end face 124 that has an inner edge 126. Each of the end faces 124 are preferably substantially flat. Each inner edge 126 defines a balancing point for balancing the golf ball when it rests on the crown 104, as seen in FIG. 6. Each balance point may contact the ball at a 90 degree angle, for example. In a preferred embodiment, there are three external prongs 120 that are spaced equidistant from one another, as seen in FIG. 3. It should be understood, however, that any number of external prongs 120 may be used and such prongs may be spaced either equidistant from one another or not equidistant from one another.

The crown 104 includes at its free end a cup portion 130 between the ends of the external prongs 120. The cup portion 130 generally includes concave walls 132 that join to form a base 134. An internal post 140 extends from the base 134 of the cup portion 130. The internal post 140 is preferably centrally disposed on the base 134 such that the internal post 140 is generally equidistant from each external prong 120, as best seen in FIG. 3. The internal post 140 includes an end face 142 which defines a contact surface for contacting the golf ball when received on the crown 104. The end face 142 may be substantially flat. The internal post 140 is designed to accept the majority of the weight of the golf ball, thereby lifting the golf ball from the base 134 of the cup portion 130. Although a preferred embodiment of the present invention includes one internal post 140 that is centrally located in the cup portion 130, it should be understood that more than one internal post may be used to support the golf ball, and those multiple internal posts may be disposed off-center.

In a preferred embodiment, the height h of the internal post 140 is less than the height H of the external prongs 120, as best seen in FIG. 6. The height h of the internal post 140 is measured from the base 134 of the cup portion 130 to the end face 142 of the post 140. The height H of each external prong 120 is likewise measured from the base 134 to the end faces 124 of the prongs 120. The height h of the internal post 140 is preferably about 20% less than the height H of the prongs 140. The external prongs 120 and the internal post 140, including the respective heights thereof, are configured such that the majority of the weight of the golf ball supported by the crown 104 is on the contact surface or end face 142 of the internal post 140 and the external prongs 120 act merely to balance the ball on the crown at the balancing points or inner edges 126. As such, the golf ball barely contacts the inner edges 126 of the external prongs 120. The internal post 140 lifts the golf ball above the typical resting point of a ball on a traditional tee, i.e. the bottom of the cup, and supports the majority of the weight of the ball so that the ball does not rest on the external prongs and instead the external prongs 120 balance the ball.

Figure 5:
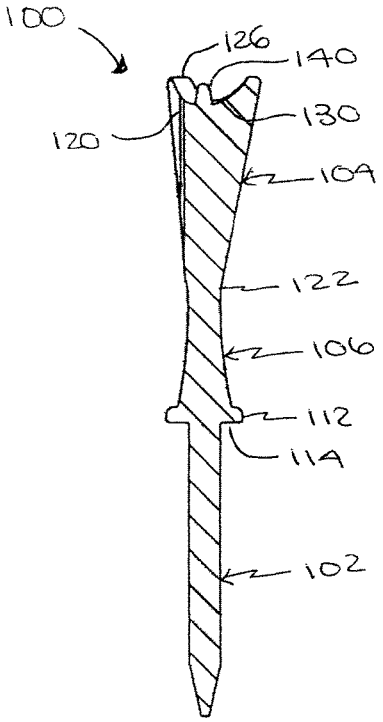
FIG. 5 is a cross-sectional view of the golf tee illustrated in FIG. 1, taken along line 5-5 of FIG. 3.

The golf tee 100 is preferably formed as a unitary one-piece member, as best seen in FIG. 5. The unitary one-piece member is preferably formed of a rigid or semi-rigid material, such as nylon, polyethylene, ABS, alloys of each, and the like. However, the components of the golf tee 100, such as the stake 102, crown 104, and neck 106, may be separately formed and attached to one another. And those separate components may be formed of the same or different materials.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

It should be understood that the inventive concepts set forth herein are not limited in their application to the construction details or component arrangements set forth in the description or illustrated in the drawings. It should also be understood that the phraseology and terminology employed herein are merely for descriptive purposes and should not be considered limiting. It should further be understood that any one of the described features may be used separately or in combination with other features. Other invented systems, methods, features, and advantages will be or become apparent to one with skill in the art upon examining the drawings and the detailed description herein. It is intended that all such additional systems, methods, features, and advantages be protected by the accompanying claims

What is claimed is:

1. A golf tee, comprising:

a stake having an insertion end; and a unitary one-piece crown for supporting a golf ball, said crown being supported by said stake opposite said insertion end, said crown having a plurality of external prongs, a cup portion defined between said plurality of external prongs, and at least one internal post extending from a base of said cup portion, said at least one internal post being disposed on said base of said cup portion between said plurality of external prongs, said at least one internal post including a ball contact surface, and a height of said at least one internal post being about 20% less than a height of each of said plurality of external prongs.

2. A golf tee according to claim 1, wherein said at least one internal post is centrally disposed on said base.

3. A golf tee according to claim 1, wherein each of said plurality of external prongs has a ball balancing point, and each of said ball balancing points is at an inner edge of each of said plurality of external prongs, respectively.

4. A golf tee according to claim 3, wherein said ball contact surface of said internal post is at an end face of a free end of said internal post.

5. A golf tee according to claim 4, wherein said ball contact surface of said at least one internal post is configured to accept a majority of the weight of the golf ball.

6. A golf tee according to claim 1, further comprising a neck disposed between said stake and said crown, said plurality of external prongs are joined at an end of said neck remote from said stake.

7. A golf tee according to claim 6, wherein said stake, said crown, and said neck are formed as a unitary one-piece member.

8. A golf tee according to claim 6, wherein said plurality of external prongs taper outwardly in a direction away from said neck.

9. A golf tee according to claim 1, further comprising a tee height indicator adjacent an end of said stake opposite said insertion end, said tee height indicator having a ground abutment surface.

10. A golf tee according to claim 9, wherein said tee height indicator is an annular shoulder and said ground abutment surface faces said insertion end of said stake.

11. A golf tee according to claim 1, wherein said plurality of external prongs includes three prongs spaced equidistant from one another.

12. A golf tee according to claim 1, wherein a golf ball resides on said ball contact surface of said at least one internal post such that a majority of the weight of said golf ball is on said ball contact surface.

13. A golf tee, comprising:

a stake having an insertion end; and a unitary one-piece crown for supporting a golf ball, said crown being supported by said stake opposite said insertion end, said crown having a plurality of external prongs, a cup portion defined between said plurality of external prongs, and at least one internal post extending from a base of said cup portion, said at least one internal post being disposed on said base of said cup portion between said plurality of external prongs, wherein said at least one internal post has a height measured from said base that is about 20% less than a height of each of said plurality of external prongs measured from said base such that each of said plurality of external prongs defines a ball balancing point at an inner edge thereof, and said at least one internal post defines a ball contact surface at an end face of a free end thereof.

14. A golf tee according to claim 13, wherein said at least one internal post is centrally disposed on said base.

15. A golf tee according to claim 13, wherein said ball contact surface of said at least one internal post is configured to accept the majority of the weight of a golf ball.

16. A golf tee according to claim 13, further comprising a neck disposed between said stake and said crown, said plurality of external prongs are joined at an end of said neck remote from said stake.

17. A golf tee according to claim 16, wherein said stake, said crown, and said neck are formed as a unitary one-piece member.

18. A golf tee according to claim 16, wherein said plurality of external prongs taper outwardly in a direction away from said neck.

19. A golf tee according to claim 13, further comprising a tee height indicator adjacent an end of said stake opposite said insertion end, said tee height indicator having a ground abutment surface.

20. A golf tee according to claim 19, wherein said tee height indicator is an annular shoulder, and said ground abutment surface faces said insertion end of said stake.

21. A golf tee according to claim 13, wherein said plurality of external prongs includes three prongs spaced equidistant from one another.

22. A golf tee according to claim 13, wherein a golf ball resides on said ball contact surface of said at least one internal post such that a majority of the weight of said golf ball is on said ball contact surface.

* * * * *